US007554266B1

(12) United States Patent
Chen

(10) Patent No.: US 7,554,266 B1
(45) Date of Patent: Jun. 30, 2009

(54) MECHANICAL SHUNT FOR USE IN A SOCKET IN A STRING OF LIGHTS

(75) Inventor: Chung-Wei Johnny Chen, Sindian (TW)

(73) Assignee: Willis Electric Co., Ltd., Sindian, Taipei County (TW)

( * ) Notice: Subject to any disclaimer, the term of this patent is extended or adjusted under 35 U.S.C. 154(b) by 0 days.

(21) Appl. No.: 12/171,896

(22) Filed: Jul. 11, 2008

Related U.S. Application Data

(60) Provisional application No. 60/971,374, filed on Sep. 11, 2007.

(51) Int. Cl.
*H01J 5/48* (2006.01)
*H01R 31/08* (2006.01)

(52) U.S. Cl. ..... 313/580; 315/185 S; 313/49; 313/50; 313/51; 313/318.01; 439/699.2; 439/252; 439/336; 362/288; 362/640; 362/654

(58) Field of Classification Search ..... 313/580, 313/318.01–318.112, 49–51; 439/699.2, 439/252, 336; 362/288, 654, 640; 315/185 S
See application file for complete search history.

(56) References Cited

U.S. PATENT DOCUMENTS

| | | | |
|---|---|---|---|
| 1,314,008 | A | 8/1919 | McWilliams |
| 1,536,332 | A | 5/1925 | Dam |
| 2,050,364 | A | 8/1936 | Morton |
| 2,484,596 | A | 10/1949 | Waltz |
| 2,984,813 | A | 5/1961 | Bossi |
| 3,286,088 | A | 11/1966 | Ahroni |
| 3,345,482 | A | 10/1967 | Lou |
| 3,359,523 | A | 12/1967 | Lou |
| 3,522,579 | A | 8/1970 | Matsuya |
| 3,783,437 | A | 1/1974 | Graff et al. |
| 4,233,543 | A | 11/1980 | Hickok |
| 4,340,841 | A | 7/1982 | Schupp |
| 4,350,407 | A | 9/1982 | Tong |
| 4,654,766 | A | 3/1987 | Tung |
| 4,808,885 | A | 2/1989 | Bauch et al. |
| 4,870,547 | A | 9/1989 | Crucefix |
| 4,991,071 | A | 2/1991 | Braasch |
| 5,139,343 | A | 8/1992 | Lin |
| 5,281,158 | A | 1/1994 | Lin |
| 5,453,664 | A | 9/1995 | Harris |
| 5,707,138 | A | 1/1998 | Pan |
| 5,791,940 | A | 8/1998 | Chen et al. |
| 5,800,047 | A | 9/1998 | Yang |
| 5,829,865 | A | 11/1998 | Ahroni |
| 5,852,348 | A | 12/1998 | Lin |
| 6,043,593 | A | 3/2000 | Pan |

(Continued)

*Primary Examiner*—Mariceli Santiago
(74) *Attorney, Agent, or Firm*—Michael A. Mann; Nexsen Pruet, LLC

(57) ABSTRACT

A mechanical shunt for use in a socket of a string of lights resides in an otherwise typical lamp of a string of lights. The present shunt is a horizontal spring held in position by a shunt holder between the two conducting terminals on the interior walls of the socket so that the lateral ends of the shunt contact the terminals when the base is removed. When the base is inserted, a depending prong on the bottom of the base presses the shunt into a V-shaped surface formed in the shunt holder to pivot the lateral ends away from the terminals and allow current to flow through the Dumet wires to the filament.

7 Claims, 3 Drawing Sheets

U.S. PATENT DOCUMENTS 6,053,774 A 4/2000 Lin
6,113,430 A 9/2000 Wu
6,217,191 B1 4/2001 Wu et al.
6,257,740 B1 7/2001 Gibboney, Jr.
6,283,797 B1 9/2001 Wu
6,347,965 B1 2/2002 Pan
6,361,368 B1 3/2002 Tseng
6,533,437 B1 3/2003 Ahroni
6,583,536 B1 6/2003 Gibboney
6,609,814 B2 8/2003 Ahroni
6,650,065 B1 11/2003 Sheih
6,764,205 B2 7/2004 Peloquin
6,774,549 B2 8/2004 Tsai et al.
6,805,463 B2 10/2004 Shieh
6,857,905 B2 2/2005 Shieh
7,186,017 B2 3/2007 Kuo
7,253,556 B1 8/2007 Gibboney
7,264,392 B2 9/2007 Massabki et al.
7,453,194 B1 * 11/2008 Gibboney ..... 313/318.1
7,473,024 B2 1/2009 Gibboney
7,484,995 B2 * 2/2009 Ding ..... 439/513
2002/0118540 A1 8/2002 Ingrassia
2003/0142494 A1 7/2003 Ahroni
2003/0156412 A1 8/2003 Limber et al.
2003/0209981 A1 11/2003 Gibboney, Jr.
2003/0214212 A1 11/2003 Gibboney, Jr.
2003/0218412 A1 11/2003 Sheih
2006/0274556 A1 12/2006 Massabki et al.
2007/0274073 A1 11/2007 Prineppi
2007/0297196 A1 12/2007 Massabki et al.
2008/0130284 A1 6/2008 Altamura et al.

* cited by examiner

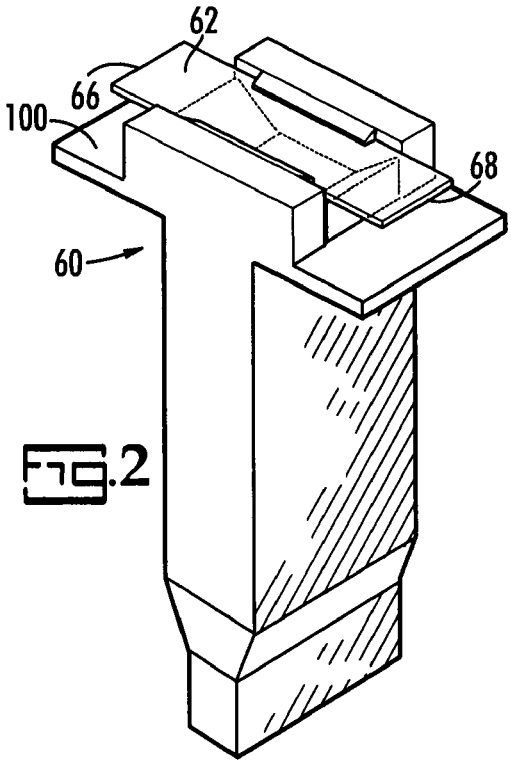
FIG.2
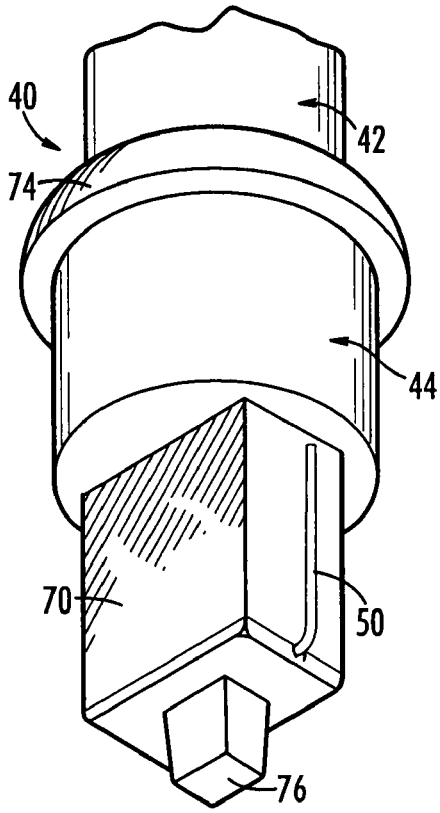
FIG.3
FIG.4
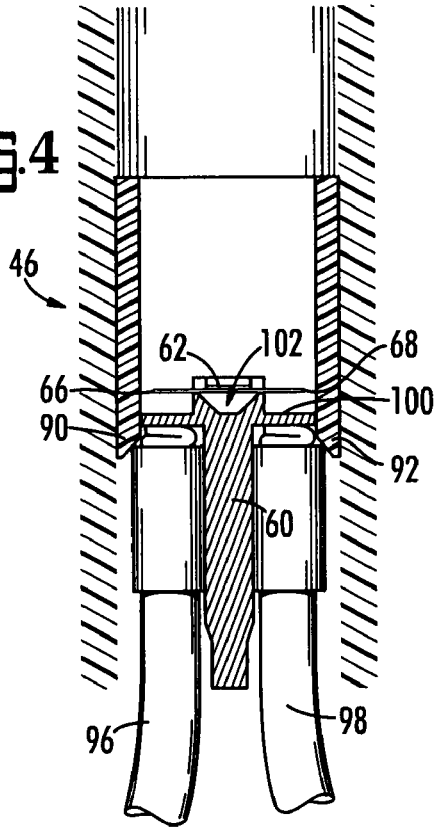

MECHANICAL SHUNT FOR USE IN A SOCKET IN A STRING OF LIGHTS

CROSS REFERENCE TO RELATED PATENTS

The priority benefit of U.S. provisional application Ser. No. 60/971,374, filed Sep. 11, 2007, is claimed.

BACKGROUND OF THE INVENTION

The present invention relates to light strings such as are used for holiday lighting.

Strings of lights are typically wired electrically in series. Consequently, when one light burns out or is removed, all the lights in the string go out. Determining which light has burned out or finding a missing bulb takes time when the string has 50 or more lights. If the string of lights is attached to a Christmas tree, locating the "bad" bulb or missing bulb is an especially tedious task.

For a number of years, this problem has been solved, or at least avoided, by the use of shunts that allow current to pass from one of the terminals in the socket of the defective lamp to the other terminal. A shunt passes the current through the lamp and allows the remaining lamps to continue to operate. Prior art shunts are sometimes placed in the glass globe of a lamp and sometimes in its socket. The shunts inside the glass globe are typically coils of wire around the conductive elements. When the filament fails, the oxide coating on the wires that theretofore prevented direct conduction of electricity is burned off and the coil welds to the elements thereby passing current.

The shunts in the socket are also of two types, solid state and mechanical. Among the mechanical, for example, there is a set of spring contacts that are the subject of U.S. Pat. No. 6,257,740. These contacts are pushed apart when the lamp base is inserted into the socket. This type is strictly for use when the bulb (and its base) is removed. This type works well and has enjoyed commercial success.

There are a huge number of light strings manufactured and sold each year throughout the world. The number is so large that even small changes that, for example, reduce material requirements or improve safety, may make a huge difference in costs of manufacture. Accordingly, there remains a need for a better mechanical shunt for use in sockets of light strings.

SUMMARY OF THE INVENTION

According to its major aspects and briefly recited, the present invention is a mechanical shunt for use in a socket of a string of lights. The shunt resides in an otherwise typical lamp of a string of lights having plural lamps electrically interconnected in series by conductive wires. Each lamp has a globe with a coiled filament running between a pair of wire conductors called Dumet wires. The Dumet wires extend outside the globe through holes formed in a base for the globe and are bent back against the outsides of the base. The base is inserted into a socket carrying two opposing electrical terminals affixed to its interior walls. These terminals are each attached to one of two insulated wires entering the bottom of socket from the next lamps in the series. As the base is inserted, the Dumet wires come into contact with the terminals and, if the insulated wires the terminals are attached to are energized, the filament incandesces.

The present shunt is a resilient spring that is held in a horizontal position by a shaped holder located inside a socket of a lamp of a light string. The shunt is positioned between the two conducting terminals. When the base is inserted, a prong on the bottom of the base presses the center of the spring shunt down against a V-shaped interior surface of the holder so that shunt itself takes on the V-shape with its lateral ends pivoted up and away from engagement with the two terminals on either side of the shunt in the socket. When the base is removed, the spring shunt resiliently returns to its original, horizontal, flat configuration, with its lateral ends back in engagement with the terminals. The spring shunt may be a flat leaf spring or a finely coiled wire.

An important advantage of the present invention is that it saves small amounts of material and is more easily manufactured than prior art mechanical shunts. Given the huge volumes of lamps manufactured every year, individual small savings collectively become a significant improvement.

These and other features and their advantages will be apparent to those skilled in the art of light string electrical design from a careful reading of the Detailed Description of Preferred Embodiments accompanied by the following drawings.

BRIEF DESCRIPTION OF THE SEVERAL VIEWS OF THE DRAWINGS

In the drawings,

FIG. 2 is a perspective view of a shunt holder with a shunt according to a preferred embodiment of the present invention;

FIG. 3 is a lower, perspective view of a base of a lamp, according to a preferred embodiment of the present invention;

FIG. 4 is a side cross-sectional view of a socket with the present shunt inside, according to a preferred embodiment of the present invention;

DETAILED DESCRIPTION OF THE INVENTION

The present invention is a lamp with a mechanical shunt for use as part of a string of lights. The term light string refers to plural, spaced-apart lamps interconnected in an electrical series by insulated electrical wiring. The term lamp refers to the combination of a bulb in a base inserted into a socket. The bulb is a partially-evacuated, transparent globe with a coiled filament and a pair of Dumet wires inside but with the Dumet wires extending from the interior to the exterior of the transparent globe. The base holds the bulb and also has two holes formed therein through which the Dumet wires pass and, once through, are folded back against the outsides of the base.

The socket includes a first and an opposing second electrical terminal connected by insulated wires entering the bottom of the socket from the adjacent lamps of the lamp set. When the base is inserted into the socket and the insulated wires are energized, current passes to the filament via the terminals on the walls of the socket and through the Dumet wires.

Figure 1:
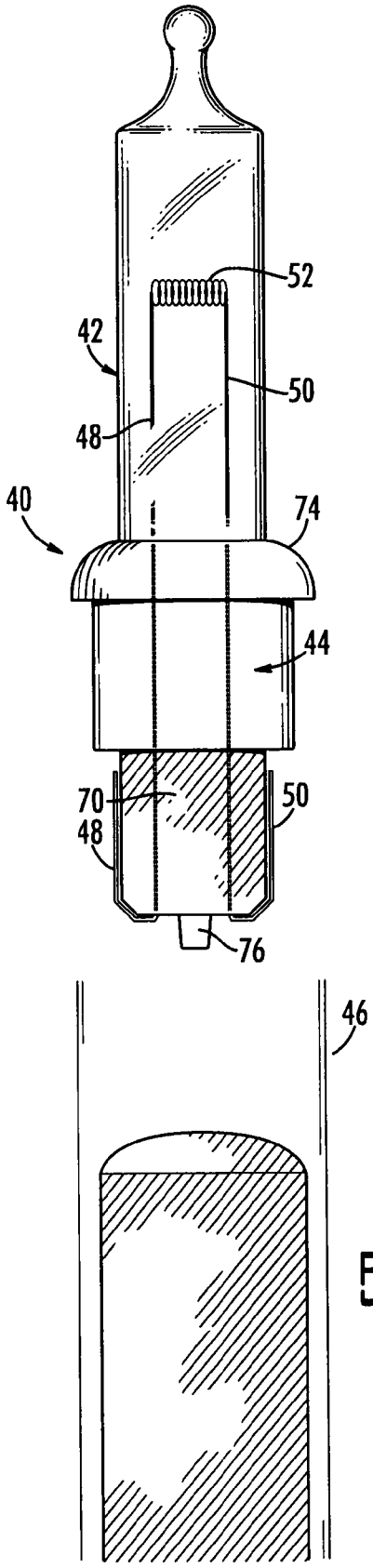
FIG. 1 is side view of a lamp with a mechanical shunt, showing the lamp and its base separated from its socket, according to a preferred embodiment of the present invention.

FIG. 1 illustrates the exterior of the present lamp, generally referred to by reference number 40, with a globe 42 and a base 44 shown removed from and above a socket 46. A first Dumet wire 48 runs from the outside of base 44, where it is folded against the outside of base 44, through a hole in base 44 into globe 42 to a filament 52 which in turn connects to a second Dumet wire 50 which then runs from inside globe 42 through a hole in base 44 to the outside of base 44, where it is also folded against the outside of base 44. Base 44 has a stop 74 formed thereon for limiting the extent to which base 44 can be inserted into socket 46. A prong 76 extends from the bottom of base 44. See also FIG. 3 which shows a perspective view of base 44. Second Dumet wire 50 and prong 76 are visible in FIG. 3.

FIG. 2 illustrates in perspective a shunt holder 60 that fits inside socket 46. Shunt holder 60 holds a shunt 62, which, as illustrated, is a thin, flat piece of resilient electrical conductor, such as a strip of metal. However, shunt 62 is alternatively a fine, coiled spring, preferably a compression spring, made of wire ¼ mm in diameter. It has a first lateral end 66 and an opposing second lateral end 68.

Figure 5:
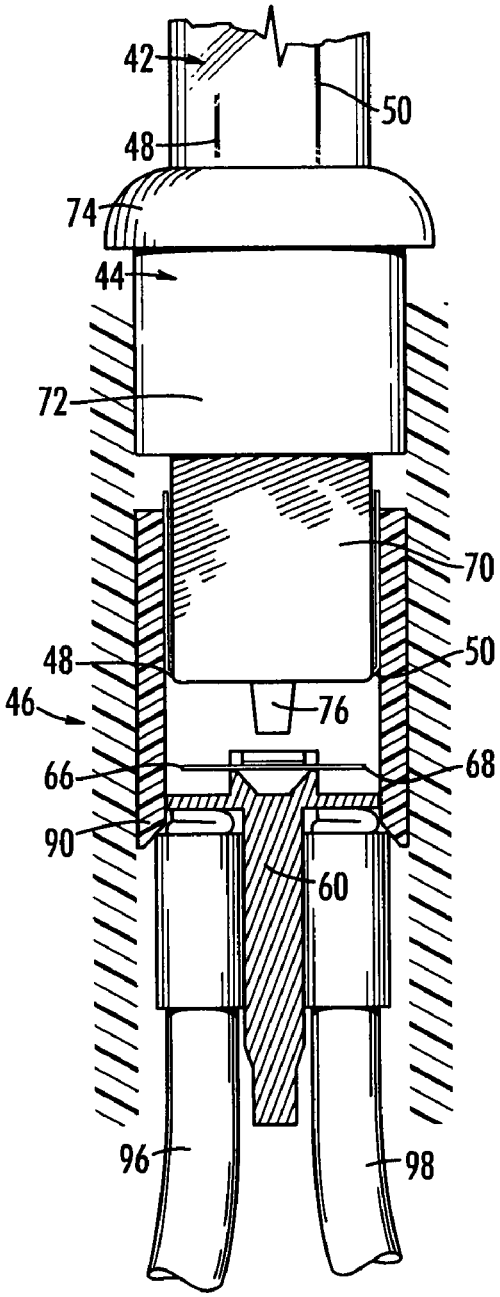
FIG. 5 is a side, cross-sectional view of a lamp with a shunt according to a preferred embodiment of the present invention, showing the base partially inserted and just touching the present shunt.
Figure 6:
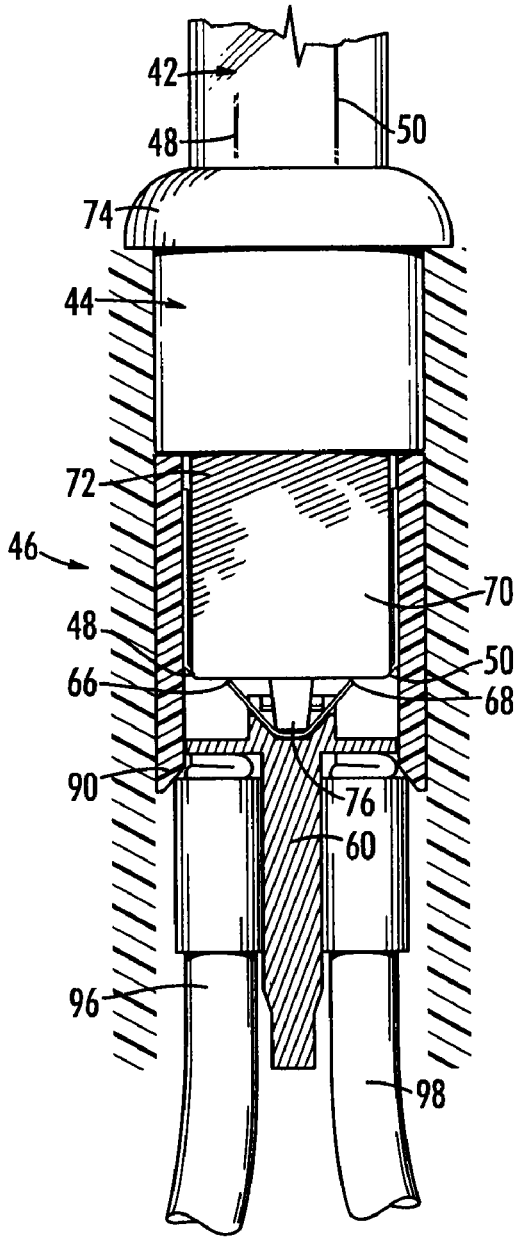
FIG. 6 is a side, cross-sectional view of the lamp with a shunt according to a preferred embodiment of the present invention, showing the base fully seated in the socket and the shunt bent so that it does not conduct between the two socket terminals.

FIGS. 4, 5 and 6 illustrate the operation of lamp 40 and shunt 62. FIG. 4 illustrates socket 46 with base removed completely. FIG. 5 is an illustration of socket 46 with base 44 partially inserted therein. FIG. 6 is an illustration of socket 46 with base 44 fully seated therein. A comparison of each of these three figures shows the operation of shunt 60 with base 44 out, partially in, and completely seated in socket 46 and the effect of prong 76 on shunt 60 and the latter's ability to conduct electrical current between the terminals inside socket 46.

FIG. 4 shows shunt 62 in its horizontal, flat configuration. Its first and second lateral ends 66, 68, respectively, are in contact with first and second terminals 90, 92 carried on the wall of socket 46. First and second terminals 90, 92 are in contact with first and second insulated wires 96, 98, respectively, which run from adjacent lamps in the series of lamps into socket 46, and thereby define an electrical path from first insulated wire 96 to first terminal 90 to first lateral end 66 of shunt 62 to second lateral end 68 of shunt 60 and thence to second terminal 92 and to second insulated wire 98. Note that shunt 60 has insulator 100 that isolates shunt 62 from the uninsulated ends of first and second insulated wires 96, 98 as it spans between first and second terminals and is positioned between first and second lateral ends 66, 68 and first and second insulated wires 96, 98. Insulator 100 prevents arcing between shunt 62 and the uninsulated ends of insulated wires 96, 98.

FIG. 5 shows prong 76 of base 44 just touching the center of shunt 62 but lateral ends 66, 68, are still in contact with first and second terminals 90, 92, and serving to conduct electricity directly between first and second terminals 96, 98 rather than through first and second Dumet wires 48, 50 and filament 52. Importantly, Dumet wires 48, 50 are now in contact with terminals 90, 92; however, shunt 62 is a preferred electrical path as it has much lower electrical resistance than filament 52.

As base 44 continues to a fully seated position, as shown in FIG. 6 when stop 74 seats against the top of socket 46, prong 76 presses down on shunt 62 which deforms against holder 60's V-shaped surface 102 taking on the V-shape and thereby pivoting its first and second lateral ends 66, 68 upward and away from first and second terminals 90, 92, thus breaking electrical contact with them and allowing current to flow through first and second Dumet wires 48, 50 and filament 52. There is no sparking when shunt 62 breaks contact, however, since Dumet wires 48, 50 are already in contact with terminals 90, 92. The removal of base 44 also avoids sparking because contact is maintained between first and second Dumet wires 48, 50, and first and second terminals 90, 92, respectively, until lateral first and second lateral ends 66, 68 of shunt 62 resiliently spring back into contact with first and second terminals 90, 92.

It is intended that the scope of the present invention include all modifications that incorporate its principal design features, and that the scope and limitations of the present invention are to be determined by the scope of the appended claims and their equivalents. It also should be understood, therefore, that the inventive concepts herein described are interchangeable and/or they can be used together in still other permutations of the present invention, and that other modifications and substitutions will be apparent to those skilled in the art from the foregoing description of the preferred embodiments without departing from the spirit or scope of the present invention.

What is claimed is:

1. A lamp for use in a light string, said lamp comprising:

a globe with a filament therein;

a base carrying said globe, said base having two holes formed therein;

first and second Dumet wires running from said filament in said globe through said holes in said base, said first and second Dumet wires being in electrical connection with said filament inside said globe, said base having a prong depending therefrom;

a socket carrying said base, said base removably seatable in said socket, said socket having an interior wall;

a first and a second terminal carried by said interior wall, said first and said second Dumet wires being in electrical connection with said first and said second terminals, respectively, when said base is seated in said socket;

first and second insulated wires entering said socket and being in electrical connection with said first and said second terminals, respectively;

a shunt holder carried by said socket, said shunt holder having a V-shaped surface formed thereon; and a conductive spring shunt having first and second lateral ends and held by said shunt holder in electrical contact with said first and second terminals when said base is not inserted in said socket, said lateral ends, said V-shaped surface and said prong of said base being dimensioned so that when said base is inserted into said socket, said prong presses said shunt into said V-shaped surface thereby pivoting said first and said second lateral ends up and away from electrical contact with said first and second terminals.

2. The lamp as recited in claim 1, wherein said shunt holder carries an insulator below said first and second lateral ends of said shunt so that said first and second lateral ends are electrically isolated from said first and said second insulated wires.

3. The lamp as recited in claim 1, wherein said shunt is a flat, resilient electrical conductor.

4. The lamp as recited in claim 1, wherein said shunt is a coiled spring.

5. A lamp for use in a light string, said lamp comprising:

a globe with a filament therein;

a base carrying said globe, said base having two holes formed therein;

first and second Dumet wires running from said filament in said globe through said holes in said base, said first and second Dumet wires being in electrical connection with said filament inside said globe;

a socket carrying said base, said base removably seatable in said socket, said socket having an interior wall;

a first and an opposing second terminal carried by said interior wall, said first and said second Dumet wires being in electrical connection with said first and said second terminals, respectively, when said base is seated in said socket;

first and second insulated wires entering said socket and being in electrical connection with said first and said second terminals, respectively; and a shunt holder carried by said socket carrying a conductive shunt having first and second lateral ends in electrical contact with said first and second terminals, respectively, when said base is not inserted in said socket, and said first and second lateral ends being not in contact with said first and second terminals when said base is seated down into said socket, said base engaging said shunt by pressing said shunt against a surface of said shunt holder, so that first and second lateral ends of said shunt are lifted up and away from said first and second terminals and out of electrical connection therewith.

6. The lamp as recited in claim 5, wherein said base has a prong on the bottom thereof and wherein said prong engages said shunt to lift said first and second lateral ends away from said first and second terminals of said socket.

7. The lamp as recited in claim 5, wherein said shunt holder has a V-shaped surface and said base presses said shunt against said V-shaped surface to lift said first and said second lateral ends.

* * * * *